US008562458B2

(12) United States Patent
Morin et al.

(10) Patent No.: US 8,562,458 B2
(45) **Date of Patent: *Oct. 22, 2013**

(54) STRIKING FACE OF A GOLF CLUB HEAD

(75) Inventors: John Morin, La Jolla, CA (US); Noah de la Cruz, Pacific Beach, CA (US); Christopher D. Harvell, Escondido, CA (US); Thomas Orrin Bennett, Carlsbad, CA (US)

(73) Assignee: Acushnet Company, Fairhaven, MA (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/619,882

(22) Filed: Sep. 14, 2012

(65) Prior Publication Data

US 2013/0012333 A1 Jan. 10, 2013

Related U.S. Application Data

(63) Continuation of application No. 12/972,807, filed on Dec. 20, 2010, now Pat. No. 8,272,975.

(51) Int. Cl.
*A63B 53/04* (2006.01)

(52) U.S. Cl.
USPC ..... 473/342

(58) Field of Classification Search
USPC ..... 473/324–350
See application file for complete search history.

(56) References Cited

U.S. PATENT DOCUMENTS

| | | | | |
|---|---|---|---|---|
| 5,366,223 | A | 11/1994 | Werner et al. | |
| 5,971,868 | A | 10/1999 | Kosmatka | |
| 6,319,150 | B1 * | 11/2001 | Werner et al. | 473/349 |
| 6,368,234 | B1 | 4/2002 | Galloway | |
| 6,402,637 | B1 * | 6/2002 | Sasamoto et al. | 473/324 |
| 6,428,426 | B1 * | 8/2002 | Helmstetter et al. | 473/330 |
| 6,428,427 | B1 | 8/2002 | Kosmatka | |
| 6,508,722 | B1 | 1/2003 | McCabe et al. | |
| 6,558,272 | B2 | 5/2003 | Helmstetter et al. | |
| 6,623,377 | B2 | 9/2003 | Evans et al. | |
| 6,652,391 | B1 | 11/2003 | Kubica et al. | |
| 6,776,726 | B2 | 8/2004 | Sano | |
| 6,800,040 | B2 | 10/2004 | Galloway et al. | |
| 6,899,638 | B2 * | 5/2005 | Iwata et al. | 473/329 |
| 6,997,820 | B2 | 2/2006 | Willett et al. | |
| 7,101,289 | B2 | 9/2006 | Gibbs et al. | |
| 7,137,907 | B2 | 11/2006 | Gibbs et al. | |
| 7,220,190 | B2 * | 5/2007 | Hirano | 473/342 |
| 7,338,388 | B2 | 3/2008 | Schweigert et al. | |
| 7,347,794 | B2 * | 3/2008 | Schweigert | 473/342 |
| 7,584,531 | B2 * | 9/2009 | Schweigert et al. | 29/557 |
| 7,749,096 | B2 | 7/2010 | Gibbs et al. | |
| 8,272,975 | B2 * | 9/2012 | Morin et al. | 473/342 |
| 8,303,432 | B2 * | 11/2012 | Curtis et al. | 473/329 |
| 2002/0160856 | A1 | 10/2002 | Evans et al. | |
| 2004/0116206 | A1 | 6/2004 | Evans et al. | |
| 2005/0137029 | A1 | 6/2005 | Evans et al. | |

FOREIGN PATENT DOCUMENTS

| | | | |
|---|---|---|---|
| JP | 2005143601 | A | 6/2005 |
| JP | 2010051707 | A | 3/2010 |
| JP | 2011125723 | A | 6/2011 |

* cited by examiner

*Primary Examiner* — Alvin Hunter
(74) *Attorney, Agent, or Firm* — Randy K. Chang

(57) ABSTRACT

A golf club head with improved striking face performance is disclosed herein. More specifically, the present invention discloses a golf club head having a thickened central region surrounded by an internal and an external transition region; wherein the thickened central region has an inner perimeter that takes on a shape that substantially resembles the shape of an outer perimeter of the striking face of the golf club head.

18 Claims, 8 Drawing Sheets

STRIKING FACE OF A GOLF CLUB HEAD

CROSS REFERENCE TO RELATED APPLICATIONS

The present application is a Continuation of co-pending U.S. patent application Ser. No. 12/972,807, filed Dec. 20, 2012, the disclosure of which is incorporated by reference in its entirety.

FIELD OF THE INVENTION

The present invention relates to an improved striking face of a golf club head. More specifically, the present invention relates to a striking face having a thickened central region surrounded by an internal and an external transition region; wherein the thickened central region has a central perimeter that takes on a shape that substantially resembles the shape of a face perimeter of the striking face of the golf club head.

BACKGROUND OF THE INVENTION

The game of golf has always been closely linked to the equipment used to play the game itself. Although the actual game of golf has not changed much since its inception in the early days of Scotland, the equipment used to play the game of golf has made significant transformations. Although it is debatable which of the numerous golf equipments have changed the most since the early days of golf, it is hard to argue that the current state of a metalwood type golf clubs are a dramatic deviation from the persimmon woods originally used during the early stages of the game of golf.

Metalwood clubs, based on their inherent design, improves upon the performance of a persimmon wood type golf club head by creating a hollowed metallic shell; which in turn, may drastically increase the coefficient of restitution of the golf club head by allowing the striking face to deflect during impact. In addition to increasing the coefficient of restitution, metalwood type golf club heads have made the game of golf easier for the average golfer by increasing the moment of inertia of the golf club head, which results from the increase in size while maintaining the stability of the golf club through impact.

Despite all the performance gains above, golf club designers have pushed the performance boundary even further by varying the thicknesses of the back of the striking face of the golf club head. Varying the thickness of the back portion of the striking face of the golf club head improves the performance of the golf club head by adjusting the flexural stiffness of the striking face of the golf club head to strategically improve the size and shape of the sweet spot on the striking face; wherein the sweet spot is defined as the portion of the striking face capable of achieving a high coefficient of restitution.

U.S. Pat. No. 6,319,150 illustrates one of the earlier attempts at varying the thickness of the face wall to maximize face strength with minimum face mass, U.S. Pat. No. 6,319,150 provides a golf club that increases the maximum size of the hitting face of the golf club that is usable by having a varying thickness to allow for additional weight to be saved and placed at strategically placed at alternative locations to improve the moment of inertia of the golf club head.

Although these early attempts at adjusting the thickness of the striking face of the golf club head are admirable in providing a foundation for the future development of this concept, most of them do not fully realize the performance benefits that can be achieved by optimizing the size, shape, and geometry of the variable thickness profile at the rear of the striking face based on the size, shape, and geometry of the striking face, U.S. Pat. No. 6,652,391 shows one attempt at varying the size, shape, and geometry of the striking face of the golf club head in an attempt to improve the performance, but it fails to correlate it to the size, shape, and geometry of the striking face itself. More specifically, U.S. Pat. No. 6,652,391 discloses a front wall that varies in thickness and has a bulging area of increased thickness on its inner surface. The bulging area of increased thickness includes a generally ring shaped mass that projects rearwardly from the front wall. A generally cone shaped mass, that also projects rearwardly from the front wall, may be located inside the ring shaped mass.

U.S. Pat. No. 6,997,820 provides another example of an alternative attempt to adjust the size, shape, and geometry of the thickness geometry behind a striking plate to further improve upon the fundamental concept of a golf club having a variable thickness face. In doing so, U.S. Pat. No. 6,997,820 discloses a face plate having a vertical zone of increased thickness and a central region having a reduced thickness. An upward extension of the vertical zone comprises divergent segments separated by an upper region of reduced thickness.

U.S. Pat. No. 7,137,907 provides a further example of another completely different geometry used to adjust the performance of a striking plate of a golf club head. More specifically, U.S. Pat. No. 7,137,907 discloses a face insert having an interior surface with a first thickness section and a second thickness region. The first thickness section preferably has a thickness that is at least 0.025 inch greater than the thickness of the second thickness region.

U.S. Pat. No. 6,623,377 provides yet another example of an attempt to adjust the performance of the golf club head by changing the thickness of the striking face. More specifically, U.S. Pat. No. 6,623,377 discloses a golf club head having a striking plate with regions of varying thickness having a central region of a first thickness that is thicker than the thickness range of any other region. The thickness of the regions decreases outward from the center.

Despite numerous attempts at adjusting the size, shape, and geometry of the rear surface of the striking face of a golf club head, none of the above mentioned patents have investigated the relationship between the size, shape, and geometry of the striking face as it relates to the geometry of the overall geometry of the striking face itself. A golf club with an optimized striking face in terms of its size, shape, and geometry may greatly improve the coefficient of restitution of the golf club head as well as increase the sweet spot of the golf club head.

Hence, as it can be seen from above, despite all the advancement in golf club technology, the current art has not carefully examined the relationship between the size, shape, and geometry of the striking face as it relates to the size, shape, and geometry of the variable face thickness profile behind the striking face. The current art, despite its numerous attempts at varying the thickness of the striking face, falls short by using random geometries that do not completely optimize the performance capabilities of a golf club head as it relates to the striking face itself. Ultimately, it can be seen from above that there is a need in the art for a golf club head that has a variable thickness geometry that optimizes the size, shape, and geometry of the various thickness levels as it relates to the striking face of the golf club head itself.

BRIEF SUMMARY OF THE INVENTION

One aspect of the present invention is a golf club head having a crown, a sole, and a skirt. The golf club head further comprises a striking face portion located at a frontal portion of the golf club head adapted to strike a golf ball and a body portion connected to the aft portion of the striking face portion. The striking face portion has a face perimeter and further comprises a thickened central region having a central perimeter, and a transition region having a transition perimeter. The central perimeter of the golf club head has a geometric shape that is substantially similar to the geometric shape of the face perimeter, and the transition region is thicker at the crown portion of the striking face than it is at the sole portion; creating a cantenary curve near the upper portion of the striking face.

Another aspect of the present invention is a golf club head having a crown, a sole, and a skirt. The golf club head further comprises a striking face portion located at a frontal portion of the golf club head adapted to strike a golf ball and a body portion connected to the aft portion of the striking face portion. The striking face portion has a face perimeter and further comprises a thickened central region having a central perimeter, and a transition region having a transition perimeter. The central perimeter of the golf club head has a geometric shape that is substantially similar to the geometric shape of the face perimeter; and a ratio of the total length of the central perimeter divided by a total length of the face perimeter is greater than about 0.23 and less than about 0.32.

A further aspect of the present invention is a golf club head having a crown, a sole, and a skirt. The golf club head further comprises a striking face portion located at a frontal portion of the golf club head adapted to strike a golf ball and a body portion connected to the aft portion of the striking face portion. The striking face portion has a face perimeter and further comprises a thickened central region having a central perimeter, and a transition region having a transition perimeter. The ratio of the total length of the central perimeter divided by a total length of the face perimeter is greater than about 0.2.3 and less than about 0.32.

These and other features, aspects and advantages of the present invention will become better understood with reference to the following drawings, description and claims.

BRIEF DESCRIPTION OF THE DRAWINGS

The foregoing and other features and advantages of the invention will be apparent from the following description of the invention as illustrated in the accompanying drawings. The accompanying drawings, which are incorporated herein and form a part of the specification, further serve to explain the principles of the invention and to enable a person skilled in the pertinent art, to make and use the invention.

DETAILED DESCRIPTION OF THE INVENTION

The following detailed description describes the best currently contemplated modes of carrying out the invention. The description is not to be taken in a limiting sense, but is made merely for the purpose of illustrating the general principles of the invention, since the scope of the invention is best defined by the appended claims.

Various inventive features are described below and each can be used independently of one another or in combination with other features. However, any single inventive feature may not address any or all of the problems discussed above or may only address one of the problems discussed above. Further, one or more of the problems discussed above may not be fully addressed by any of the features described below.

Figure 1:
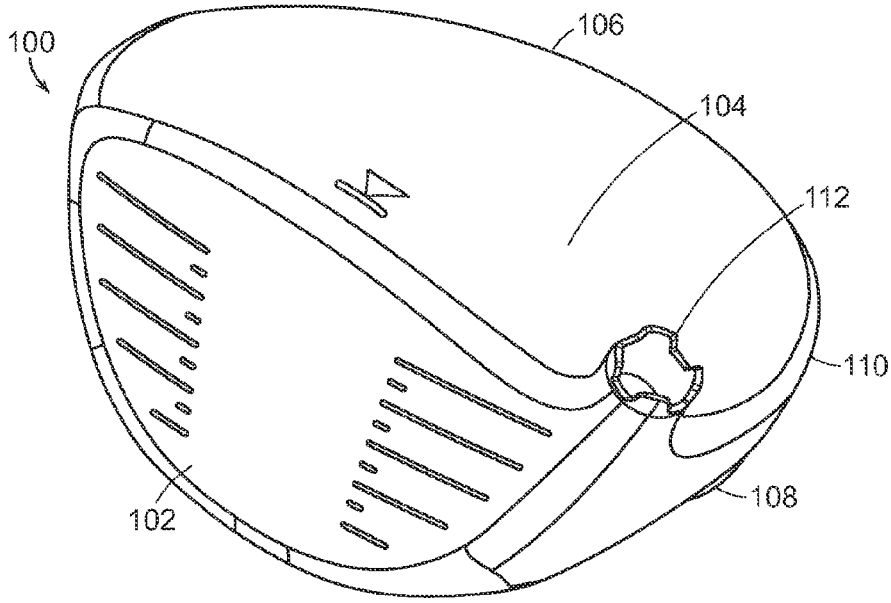
FIG. 1 shows a perspective view of a golf club head in accordance with an exemplary embodiment of the present invention.

FIG. 1 of the accompanying drawings shows a perspective view of a golf club head 100 in accordance with an exemplary embodiment of the present invention. The golf club head 100 shown in FIG. 1 may generally have a striking face portion 102 located at a frontal portion of the golf club head 100 that is adapted to strike a golf ball (not shown) and a body portion 104 that is connected to an aft portion of the striking face portion 102. The body portion 104 of the golf club head 100 may generally have a crown portion 106, a sole portion 108, and a skirt portion 110 to round up the various components of the golf club head 100. Although not externally visible, the striking face portion 102 of the golf club head 100 may generally have an unique internal geometry that varies the thickness of the striking face portion 102 in a way that is related to the size, shape, and geometry of the striking face portion 102 itself.

Figure 2:
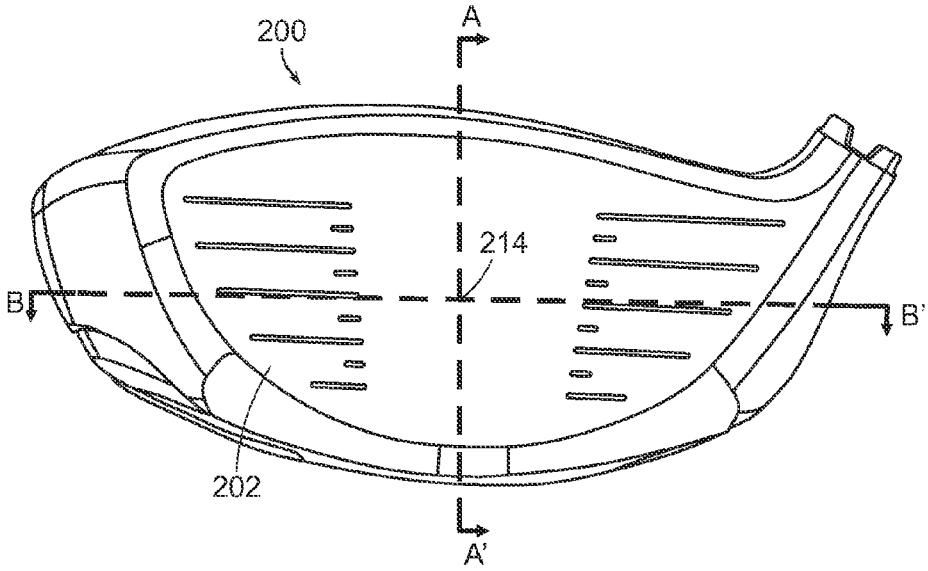
FIG. 2 shows a frontal view of a golf club head in accordance with an exemplary embodiment of the present invention.

In order to more closely examine the internal geometry of the striking face portion 102, a cross-sectional view of the golf club head 100 must be first defined. FIG. 2 of the accompanying drawings showing a frontal view of a golf club head 200 provides an easy methodology to define the necessary cross-sectional views. More specifically, FIG. 2 shows cross-sectional line A-A' spanning vertically across the geometric center 214 of the striking face 202 in a crown to sole direction. In addition to the above, FIG. 2 also shows cross-sectional line B-B' spanning horizontally across the geometric center 214 of the striking face 202 in a heel to toe direction. It is worthwhile to mention here that the geometric center 214 of the striking face 202 may generally refer to a point on the surface of the striking face 202 that depicts the central point within the striking face 202.

Figure 3:
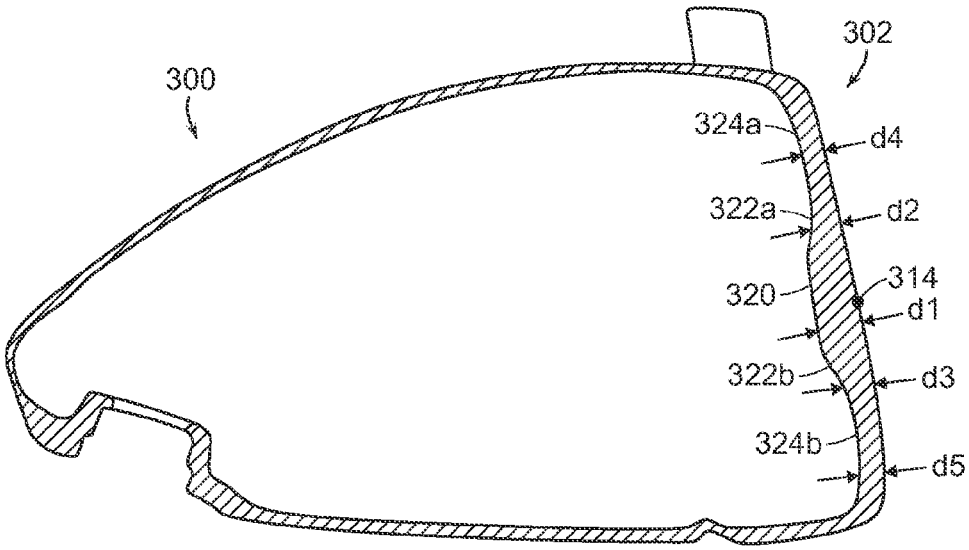
FIG. 3 shows a cross-sectional view of a golf club head in accordance with an exemplary embodiment of the present invention taken along cross-sectional line A-A' shown in FIG. 2.

FIG. 3 of the accompanying drawings shows a cross-sectional view of the golf club head 200 shown in FIG. 2 taken along cross-sectional line A-A'. This cross-sectional view of the golf club head 300 shown in FIG. 3 allows the variable thickness geometry behind the striking face 302 to be shown. More specifically, the striking face 302 may generally have a thickened central region 320, an internal transition region 322, and an external transition region 324. The thickened central region 320, as shown in this current exemplary embodiment, may generally have a thickness d1 of greater than about 3.00 mm, more preferably greater than about 3.30 mm, and most preferably greater than about 3.60 mm. The internal transition region 322, as shown in this current exemplary embodiment, may generally gradually decrease in the thickness of the striking face 302 as it moves further away from the geometric center 314 of the striking face 302. It should be noted here that in this current exemplary embodiment of the present invention the internal transition region 322 are not symmetrical in the vertical direction. In fact, the upper internal transition region 322*a* may generally be thicker than the lower internal transition region 322*b*. More specifically, the thickness d2 of the upper inner transition region 322*a* near the crown portion of the striking face 302 may gradually decrease from about 3.60 mm to about 2.90 mm, more preferably from about 3.60 mm to about 2.80 mm, and most preferably, from about 3.60 mm to about 2.70 mm. The thickness d3 of the tower internal transition region 322*b* near the sole portion of the striking face 302 may gradually decrease from about 3.60 mm to about 2.80 mm, more preferably from about 3.60 mm to about 2.70 mm, and most preferably from about 3.60 mm to about 2.60 mm.

Similar to the internal transition region 322, the external transition region 324 is also not symmetrical in the vertical direction. The upper external transition region 324*a* may generally be thicker than the lower external transition region 324*b*. More specifically, the thickness d4 of the upper external transition region 324*a* near the crown portion of the striking face 302 may generally transition from about 2.90 mm to about 2.93 mm, more preferably from about 2.80 mm to about 2.83 mm, and most preferably from about 2.70 mm to about 2.73 mm. The thickness d5 of the lower internal transition region 324*b* near the sole portion of the striking face 302 may gradually transition from about 2.80 mm to about 2.78 mm, more preferably from about 2.70 min to about 2.68 mm, and most preferably from about 2.60 mm to about 2.58 mm. Based on the various thicknesses d1, d2, d3, d4, and d5 mentioned above, it can be seen that the striking face 302 shown in this exemplary embodiment of the present invention may have a thicker upper portion, a thinner lower portion, combined with a thickened central region 320 to help create a geometry that optimizes the performance of the golf club head 300. Alternatively speaking, it can be said that the upper internal transition region 322*a* and the upper external transition region 324*a* combine with one another to form a catenary curve near the upper portion of the striking face 302 while the lower internal transition region 322*b* and the lower external transition region 324*b* form a curve that is constantly decreasing in thickness.

Figure 4:
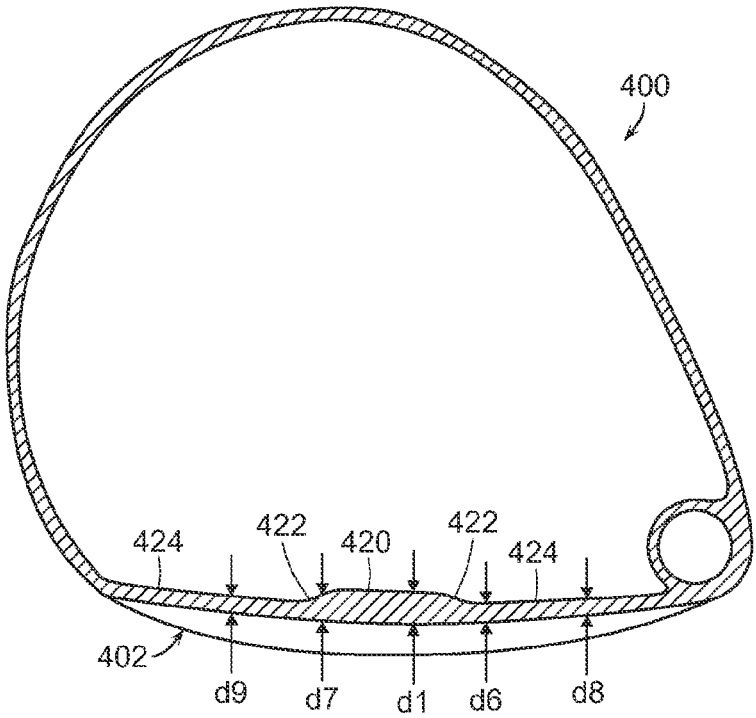
FIG. 4 shows a cross-sectional view of a golf club head in accordance with an exemplary embodiment of the present invention taken along cross-sectional line B-B' shown in FIG. 2.

FIG. 4 of the accompanying drawings shows a cross-sectional view of a golf club head 400 in accordance with an exemplary embodiment of the present invention, taken across a horizontal cross-sectional line B-B' shown in FIG. 2. Similar to the previous cross-section shown in FIG. 3, FIG. 4 shows the striking face 402 of the golf club head 400 having a thickened central region 420, an internal transition region 422, and an external transition regions 424. Although FIG. 3 showed the crown portion of the striking face 302 being thicker than the sole portion of the striking face 302, the same phenomenon is not necessarily apparent along the heel to toe direction. Hence, internal transition region 422 may generally have thicknesses d6 and d7 that decreases from about 3.60 mm to about 2.70 mm, more preferably from about 3.60 mm to about 2.65 mm, and most preferably from about 3.60 mm to about 2.60 mm. Accordingly, external transition regions 424 may have thicknesses d8 and d9 that decreases from about 2.70 mm to about 2.55 mm, more preferably from about 2.65 mm to about 2.50 mm, and most preferably from about 2.60 mm to about 2.45 mm.

It is worth noting that in FIGS. 3 and 4, the cross-sectional view of the golf club head 300 and 400 shows a gradual transition of the thickness of the striking face 302 and 402 from the thickened central region 320 and 420 towards the outer perimeter of the striking face 302 and 402. This gradual transition of the thickness of the striking face 302 and 402, as shown in this current exemplary embodiment, is achieved by a combination of both the internal transition zone 322 and 422 and the external transition zone 324, and 424. Having a gradual transition across the entire striking face 302 and 402 of the golf club head is beneficial to the performance of the golf club head 300 and 400, as it significantly decreases locations of increased stress, allowing the striking face 302 and 402 to be made thinner to save weight from the golf club head 300 and 400.

Figure 5:
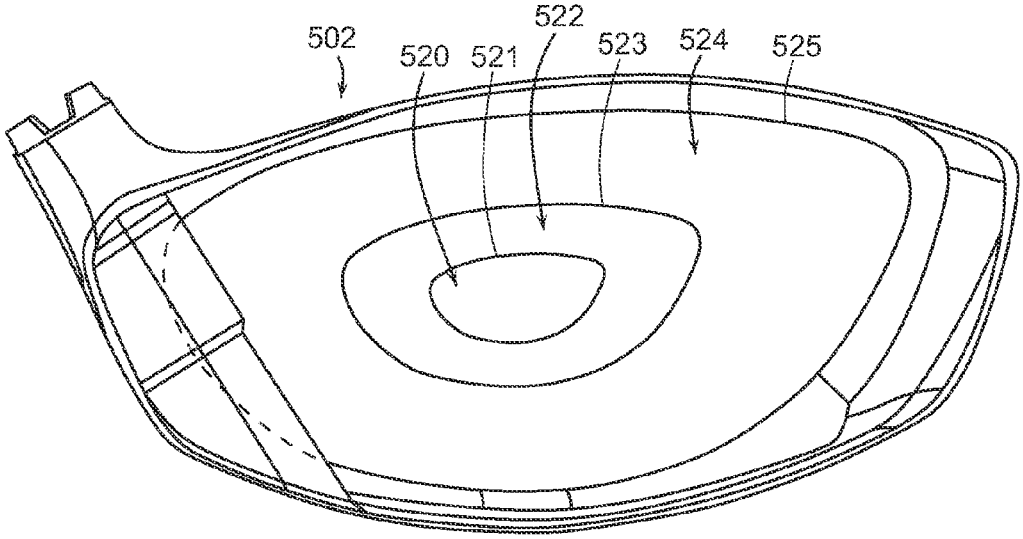
FIG. 5 shows a rear view of a cut-open golf club head that illustrates the striking face in accordance with an exemplary embodiment of the present invention.

FIG. 5 provides the final piece of the puzzle to clearly define the size, shape, and geometry of the striking face 502 in accordance with an exemplary embodiment of the present invention. More specifically, FIG. 5 of the accompanying drawings shows a rear view of a golf club head that has been cut open to illustrate the rear portion of the striking face 502. Striking face 502, as shown in FIG. 5, may generally have a thickened central region 520 having a central perimeter 521, an inner transition region 522 having an internal transition perimeter 523, and an external transition region 524 having an external transition perimeter 525. It should be noted that the length of the external transition perimeter 525 shown in this current exemplary embodiment of the present invention may generally be equivalent to the length of the perimeter of the striking face 502, as the striking face 502 is continuously decreasing in thickness all the way up to the perimeter of the striking face 502. Hence the term striking face perimeter 525 may be used interchangeably with the external transition perimeter 525 within the context of this application without departing from the scope and content of the present invention.

The boundaries of the face perimeter 525, as shown in the current exemplary embodiment of the present invention in FIG. 5 may generally be difficult to visually define from the back view of the striking face 502. Hence, it is worthwhile to take the time here and clearly define the boundaries of the face perimeter 525, as it is used to help define the size, shape, and geometry of the thickened central portion 520 of striking face 502. Face perimeter 525 may generally be defined as the boundary of the frontal striking portion of the striking face 502, with its boundaries defined by the radius of curvature that substantially deviates from the frontal planar striking surface of the striking face 502. Because the hosel portion of the striking face 502 may not contain a radius of curvature that substantially deviates from the planar striking surface, that portion of the face perimeter 525 may generally be estimated by a smooth curvature that completes the definable terminal ends of the face perimeter 525.

Now that the boundary of the face perimeter 525 has been established, the relationship between the face perimeter 525 and the central perimeter 521 may now be defined. As previously stated, the size, shape, and geometry of the thickened central region 520 may be substantially similar to the size, shape, and geometry of the striking face 502, and their relationship relative to one another helps quantify the performance gains of the golf club head. In addition to the similarity in size, shape, and geometry between the thickened central region 520 and the striking face 502, the inner transition region 522 may also have a size, shape, and geometry that is substantially similar to the striking face 502. In the current exemplary embodiment of the present invention, the length of the central perimeter 521 may generally be greater than about 65 mm and less than about 80 mm, more preferably greater than about 70 mm and less than about 75 mm, most preferably about 73 mm. The length of the face perimeter 525, on the other hand, may generally be greater than about 250 mm and less than about 280 mm, more preferably greater than about 260 mm and less than about 270 mm, and most preferably about 265 mm.

An evaluation of the different perimeter lengths mentioned above provides a very important relationship between the central perimeter 521 and the face perimeter 525. More specifically, based on the above, it can be concluded that the ratio of the length of the central perimeter 521 divided by the length of the face perimeter 525 may generally be greater than about 0.23 and less than about 0.32, more preferably greater than about 0.26 and less than about 0.28, and most preferably about 0.27. This ratio of the central perimeter 521 divided by the face perimeter 525 is important to the performance of the golf club head because it controls the size of the thickened central region 520, which controls the size of the sweet spot.

In addition to the various geometric relationships discussed above, the size of the thickened central region 520 is also important to the performance of the striking face 502 of the golf club head. More specifically, as it can be seen in FIG. 5, it is generally desirable to have the size of the thickened central region 520 be significantly smaller than the overall size of the striking face 502 that is defined by the face perimeter 525. The size of the thickened central region 520, defined by the length of the inner transition region 522 may generally be between about 20% to about 40% of the size of the striking face 502, defined by the length of the face perimeter 525, more preferably between about 25% to about 35% of the size of the face perimeter 525, and most preferably about 30% of the face perimeter 525.

Finally, it is worth recognizing here that the rear view of the striking face 502 shown in FIG. 5 shows a relationship of the geometric shapes of the thickened central region 520 and the striking face 502. More specifically, FIG. 5 of the accompanying drawings shows that both the thickened central region 520 and the inner transition region 522 have a geometry that substantially resembles the geometry of the face perimeter 525. Alternatively speaking, the central perimeter 521 and the internal transition perimeter 523 may all form a geometric shape that is substantially similar to the geometric shape of the face perimeter 525. It is important to recognize here that having the thickened central region 520 take on a shape that substantially resembles the geometry of the entire striking face 502 is beneficial to the performance of the golf club head because it allows for a more uniform deflection of the striking face 502 along all directions to create a larger "sweet spot". "sweet spot", although commonly used within the golf industry as a desirable indicator of golf club performance, is seldom defined in a way that is easily quantifiable. Hence, in an attempt to quantify the performance gains of the current invention by having such an improved geometry of the thickened central region 520, the sweet spot" is defined as the portion of said striking face 502 that is capable of achieving 98% of a maximum ballspeed that can result from an impact with a golf ball.

Figure 6:
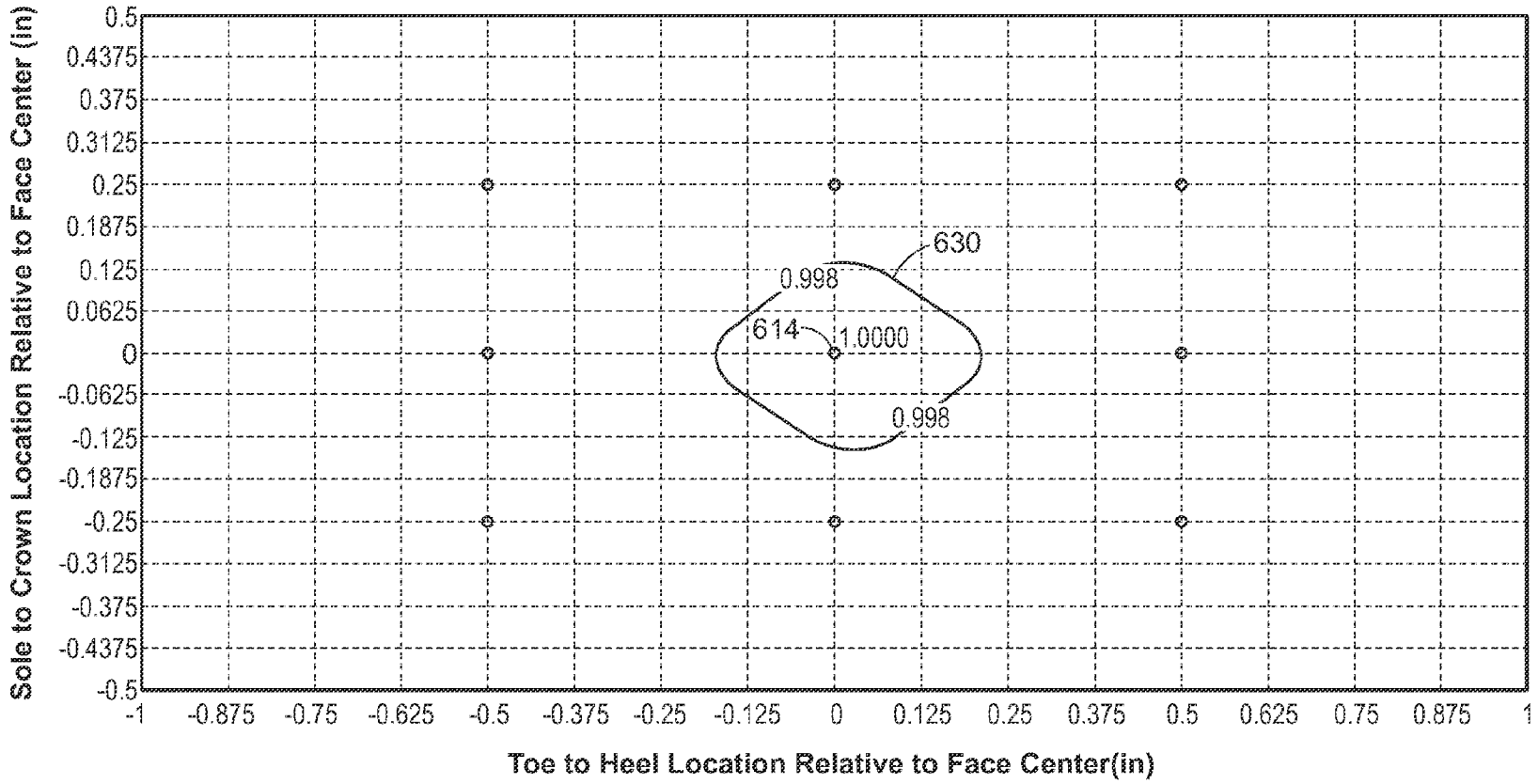
FIG. 6 shows a pictorial representation of the "sweet spot" associated with a golf club head in accordance with an exemplary embodiment of the present invention.

FIG. 6 of the accompanying drawings shows a pictorial representation of the sweet spot 630 as it is shown relative to the face center 614 of a golf club head. As it can be seen from FIG. 6, the area encompassed by the sweet spot 630 may generally encircle the face center 614 and take on a substantially oval shape. In addition to having a substantially oval shape, the area covered by this sweet spot 630 may generally be greater than about 45 $mm^2$, more preferably greater than about 46.5 $mm^2$, and most preferably greater than about 48.0 $mm^2$. This enlarged sweet spots is important to highlight because it directly quantifies the performance gains of the current inventive golf club head that can be attributed to the improved size, shape, and geometry of the thickened central region 520. This larger sweet spot is preferable because provides a greater area for a golfer to strike a golf ball and still achieve substantially the same results as a perfectly impacted golf ball.

Figure 7:
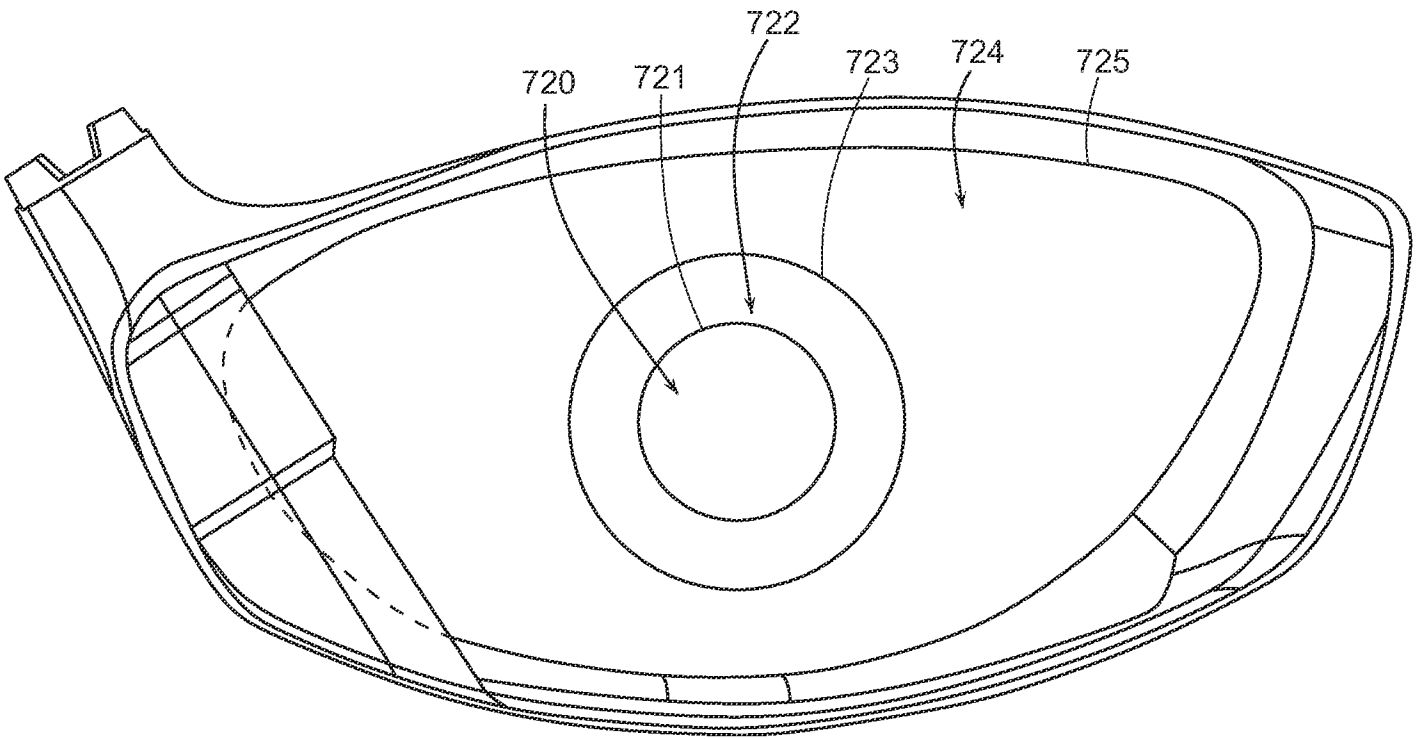
FIG. 7 (Prior Art)
FIG. 7 shows a rear view of a cut-open golf club head that illustrates the striking face of a prior art golf club head.
Figure 8:
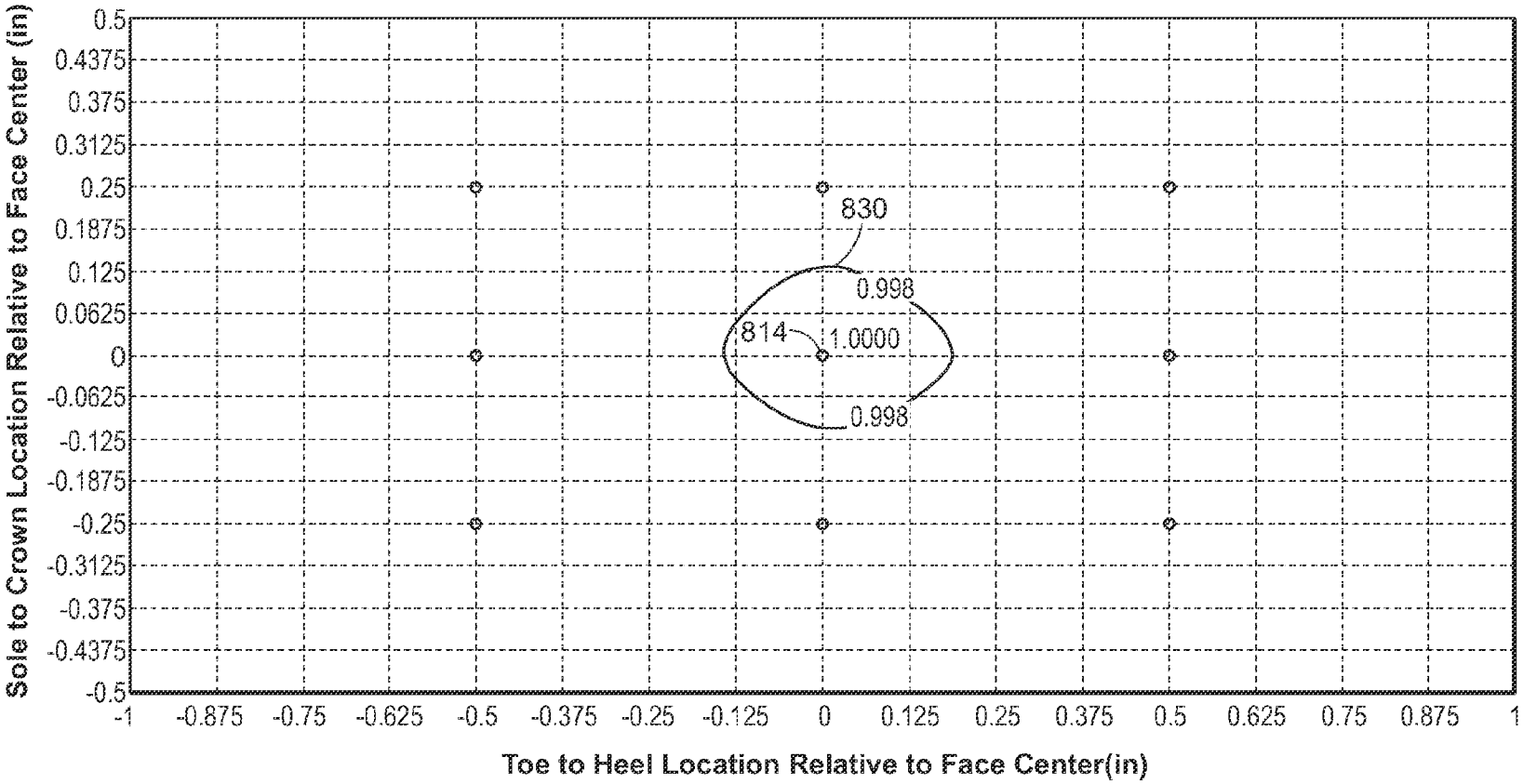
FIG. 8 (Prior Art)
FIG. 8 shows a pictorial representation of the sweet spot associated with a prior art golf club head.

For comparative purposes, FIGS. 7 and 8 of the accompanying drawings shows the rear view of a prior art golf club head and the pictorial representation of the sweet spot associated with such a prior art golf club head. In FIG. 7, despite the fact that this prior art golf club head has a striking face 702 with a thickened central region 720, the arbitrary circular shape of the central perimeter 721 that is not in congruence with the geometry of the face perimeter 725 will negatively affect the size of the sweet spot. Hence, turning to FIG. 8, we can see that the size of the sweet spot 830 for this prior art golf club head is significantly smaller than the sweet spot 630 of the inventive golf club head. In fact, the size of this sweet spot 830 may generally be less than about 35 $mm^2$, more preferably less than about 30 $mm^2$, and most preferably less than about 27 mm.

Figure 9:
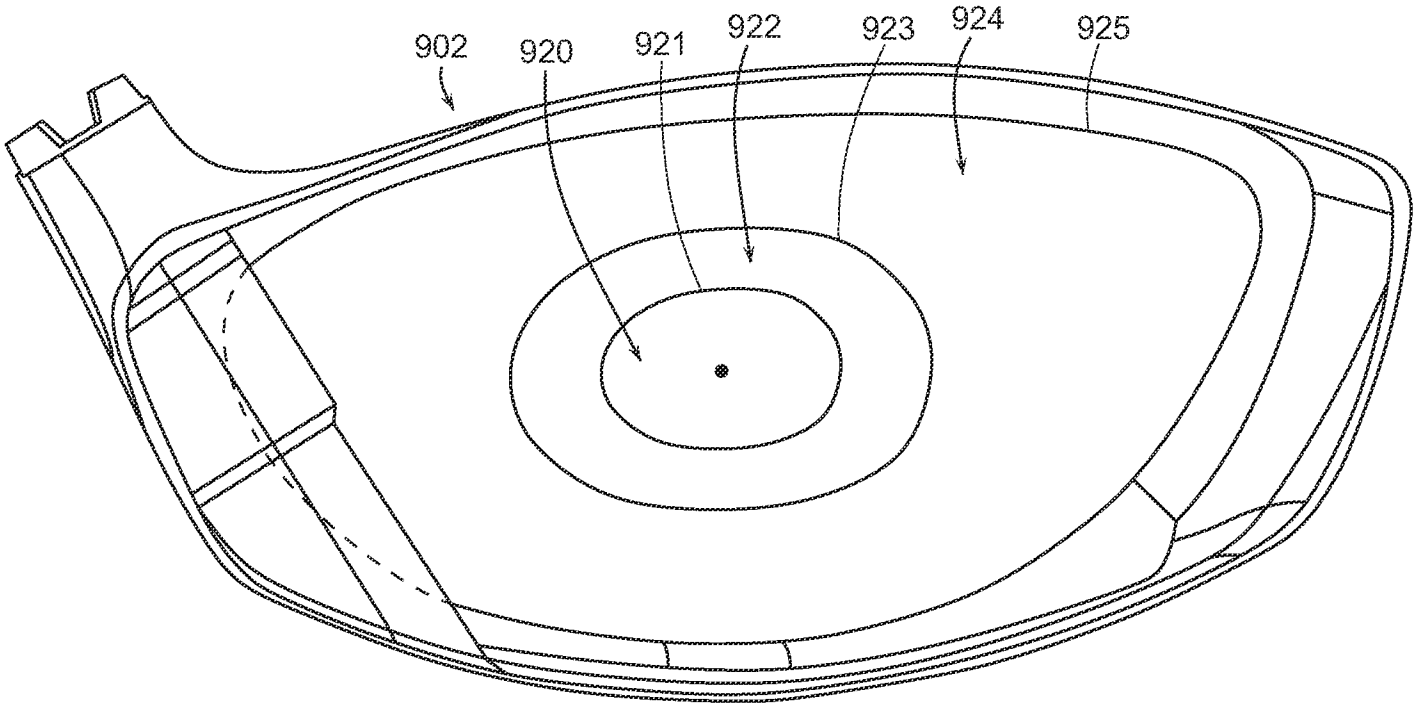
FIG. 9 shows a rear view of a cut-open golf club head that illustrates the striking face in accordance with an alternative embodiment of the present invention.

FIG. 9 of the accompanying drawings shows a rear view of a golf club head in accordance with an alternative embodiment of the present invention wherein the thickened central region 920 has a geometric shape that substantially resembles the geometry of the striking face perimeter 925. In this current exemplary embodiment of the present invention shown in FIG. 9, it can be seen that although the geometry of the central perimeter 921 of the thickened central region 920 may not be identical to the face perimeter 925 of the striking face 902, it can still be considered to be substantially resembling without departing from the scope and content of the present invention. More specifically, the term "substantially similar" as defined by the current invention does not require one hundred percent congruence, but only that the shapes loosely resemble one another.

Figure 10:
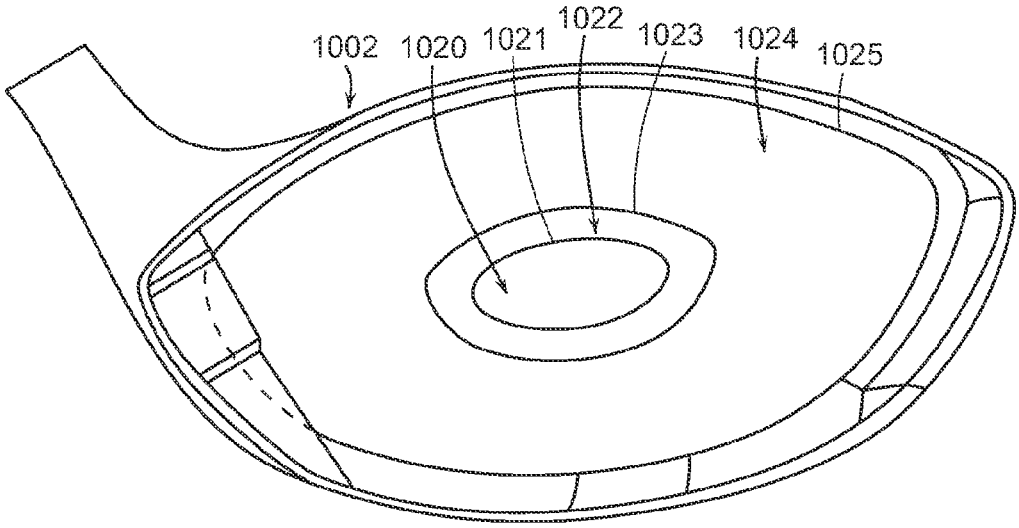
FIG. 10 shows a rear view of a cut-open golf club head that illustrates the striking face in accordance with a further alternative embodiment of the present invention.

FIG. 10 of the accompanying drawings provides a rear view of a striking face 1002 of a golf club head in accordance with an alternative embodiment of the present invention. Although the thickened central region 1020 of the present embodiment may take on a different shape that is more oval than previously shown, this shape still substantially resembles the oval geometry of the face perimeter 1025. Like the discussion above, in order to maximize the performance of the striking face 1002 of the golf club head, it is important to control the geometry of the thickened central region 1020 as it relates to the geometry of the striking face 1002, not as an independent shape. Similar to the above, the ratio of the length of the central perimeter 1021 divided by the length of the face perimeter 1025 be may generally be greater than about 0.23 and less than about 0.32, more preferably greater than about 0.26 and less than about 0.28, and most preferably about 0.27 without departing from the scope and content of the present invention.

Figure 11:
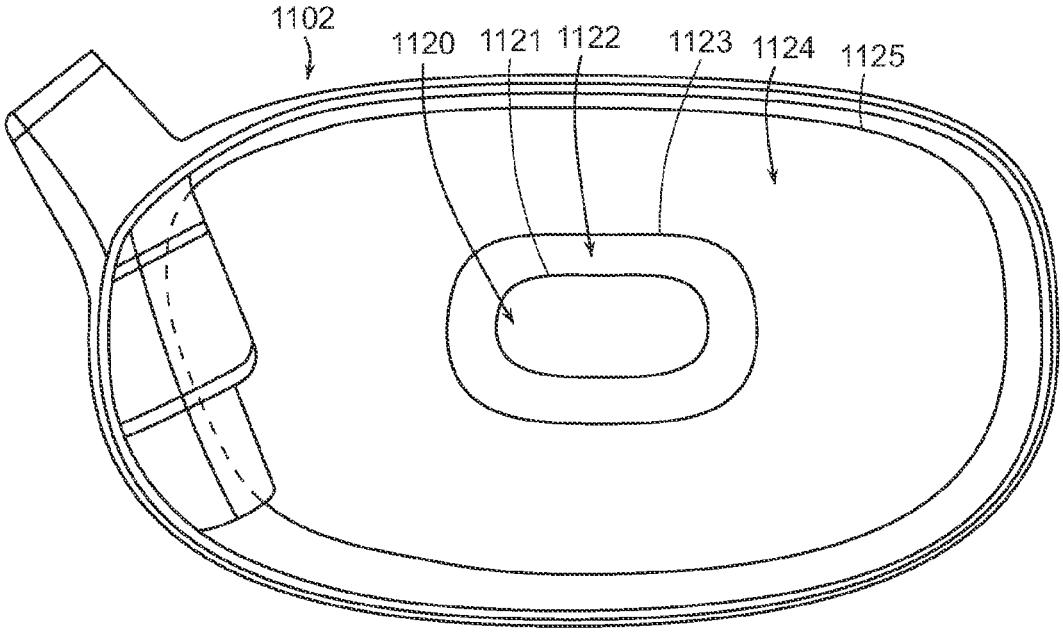
FIG. 11 shows a rear view of a cut-open golf club head that illustrates the striking face in accordance with a further alternative embodiment of the present invention.

FIG. 11 of the accompanying drawings provides a rear view of a striking face 1102 of a golf club head in accordance with an alternative embodiment of the present invention. Although the thickened central region 1120 of the present embodiment may take on a different shape that is more circular than previously shown, this shape still substantially resembles the substantially circular geometry of the face perimeter 1125. Like the discussion above, in order to maximize the performance of the striking face 1102 of the golf club head, it is important to control the geometry of the thickened central region 1120 as it relates to the geometry of the striking face 1102, not as an independent shape. Similar to the above, the ratio of the length of the central perimeter 1121 divided by the length of the face perimeter 1125 be may generally be greater than about 0.23 and less than about 0.32, more preferably greater than about 0.26 and less than about 0.28, and most preferably about 0.27 without departing from the scope and content of the present invention.

Other than in the operating example, or unless otherwise expressly specified, all of the numerical ranges, amounts, values and percentages such as those for amounts of materials, moment of inertias, center of gravity locations, loft, draft angles, various performance ratios, and others in the aforementioned portions of the specification may be read as if prefaced by the word "about" even though the term "about" may not expressly appear in the value, amount, or range. Accordingly, unless indicated to the contrary, the numerical parameters set forth in the above specification and attached claims are approximations that may vary depending upon the desired properties sought to be obtained by the present invention. At the very least, and not as an attempt to limit the application of the doctrine of equivalents to the scope of the claims, each numerical parameter should at least be construed in light of the number of reported significant digits and by applying ordinary rounding techniques.

Notwithstanding that the numerical ranges and parameters setting forth the broad scope of the invention are approximations, the numerical values set forth in the specific examples are reported as precisely as possible. Any numerical value, however, inherently contains certain errors necessarily resulting from the standard deviation found in their respective testing measurements. Furthermore, when numerical ranges of varying scope are set forth herein, it is contemplated that any combination of these values inclusive of the recited values may be used.

It should be understood, of course, that the foregoing relates to exemplary embodiments of the present invention and that modifications may be made without departing from the spirit and scope of the invention as set forth in the following claims.

What is claimed is:

1. A golf club head having a crown, a sole, and a skirt comprising:

a striking face portion located at a frontal portion of said golf club head adapted to strike a golf ball, said striking face portion having a face perimeter; and a body portion connected to an aft portion of said striking face portion;

wherein said striking face portion further comprises;

a thickened central region having a central perimeter, and a transition region having a transition perimeter, wherein said transition region is thicker at said crown portion of said striking face than it is at said sole portion of said striking face; creating a catenary curve near an upper portion of said striking face; and wherein a ratio of a total length of said central perimeter divided by a total length of said face perimeter is greater than about 0.23 and less than about 0.32.

2. The golf club head of claim 1, wherein said ratio of said total length of said central perimeter divided by said total length of said face perimeter is greater than about 0.26 and less than about 0.28.

3. The golf club head of claim 2, wherein said ratio of said total length of said central perimeter divided by said total length of said face perimeter is about 0.27.

4. The golf club head of claim 3, wherein said total length of said central perimeter is greater than about 65 mm and less than about 80 mm.

5. The golf club head of claim 4, wherein said total length of said central perimeter is greater than about 70 mm and less than about 75 mm.

6. The golf club head of claim 5, wherein said total length of said central perimeter is about 73 mm.

7. A golf club head having a crown, a sole, and a skirt comprising:

a striking face portion located at a frontal portion of said golf club head adapted to strike a golf ball, said striking face portion having a face perimeter; and a body portion connected to an aft portion of said striking face portion;

wherein said striking face portion further comprises;

a thickened central region having a central perimeter, and a transition region having a transition perimeter, and wherein said ratio of said total length of said central perimeter divided by said total length of said face perimeter is greater than about 0.26 and less than about 0.28.

8. The golf club head of claim 7, wherein said ratio of said total length of said central perimeter divided by said total length of said face perimeter is about 0.27.

9. The golf club head of claim 7, wherein said sole portion of said transition region forms a curve that is constantly decreasing in thickness.

10. The golf club head of claim 7, wherein a size of a sweet spot of said striking face portion of said golf club head is greater than about 45 $mm^2$;

said sweet spot is defined as the area of said striking face portion that is capable of achieving 98% of a maximum ballspeed that can result from an impact with said golf ball.

11. The golf club head of claim 10, wherein said size of said sweet spot is greater than about 46.5 $mm^2$.

12. The golf club head of claim 11, wherein said size of said sweet spot is greater than about 48 $mm^2$.

13. A golf club head having a crown, a sole, and a skirt comprising:

a striking face portion located at a frontal portion of said golf club head adapted to strike a golf ball, said striking face portion having a face perimeter; and a body portion connected to an aft portion of said striking face portion;

wherein said striking face portion further comprises;

a thickened central region having a central perimeter, and a transition region having a transition perimeter, and wherein a total length of said central perimeter is greater than about 65 mm and less than about 80 mm.

14. The golf club head of claim 13, wherein said total length of said central perimeter is greater than about 70 mm and less than about 75 mm.

15. The golf club head of claim 14, wherein said total length of said central perimeter is about 73 mm.

16. The golf club head of claim 13, a total length of said face perimeter is greater than about 250 mm and less than about 280 mm.

17. The golf club head of claim 16, wherein said total length of said face perimeter is greater than about 260 mm and less than about 270 mm.

18. The golf club head of claim 17, wherein said total length of said face perimeter is about 265 mm.

* * * * *